US005564973A

United States Patent [19]

Salvail

[11] Patent Number: 5,564,973

[45] Date of Patent: Oct. 15, 1996

[54] PORTABLE SHARPENER

[76] Inventor: Roger Salvail, 187 Des Ormes, Drummondville, Quebec, Canada, J2C 1T2

[21] Appl. No.: 218,917

[22] Filed: Mar. 28, 1994

Related U.S. Application Data

[63] Continuation-in-part of Ser. No. 950,851, Sep. 25, 1992, Pat. No. 5,381,629.

[30] Foreign Application Priority Data

Mar. 26, 1993 [CA] Canada ..... 2092791

[51] Int. Cl.[6] ..... B21F 17/00

[52] U.S. Cl. ..... 451/540; 451/545; 451/557

[58] Field of Search ..... 451/557, 540, 451/545, 28, 45

[56] References Cited

U.S. PATENT DOCUMENTS

| | | | |
|---|---|---|---|
| 2,042,916 | 6/1936 | Viozzi | 451/558 |
| 2,054,495 | 9/1936 | Corkum | 451/558 |
| 2,092,831 | 9/1937 | Cannon | 451/558 |
| 2,118,617 | 5/1938 | Nicolet | 451/558 |
| 2,428,473 | 10/1947 | Slocum | 451/558 |
| 2,542,281 | 2/1951 | Lefteruk | 451/540 |
| 2,999,402 | 9/1961 | Bratton | 76/83 |
| 3,157,973 | 11/1964 | Chattillion | 451/558 |
| 3,585,880 | 6/1971 | Kabriel | 76/83 |
| 3,841,030 | 10/1974 | Laszlo | 451/558 |
| 3,921,341 | 11/1975 | Thompson | 451/558 |
| 4,617,765 | 10/1986 | Weiler | 451/558 |
| 4,756,125 | 7/1988 | Kadnar | 451/241 |
| 4,815,240 | 3/1989 | Larson | 451/555 |
| 4,908,994 | 3/1990 | Fraser | 451/545 |
| 5,189,845 | 3/1993 | Courchesne | 451/557 |
| 5,195,277 | 3/1993 | Courchesne | 451/58 |
| 5,381,629 | 1/1995 | Salvail | 451/540 |

FOREIGN PATENT DOCUMENTS 2043165 12/1991 Canada .

*Primary Examiner*—Timothy V. Eley
*Attorney, Agent, or Firm*—Foley & Lardner

[57] ABSTRACT

A portable sharpener for sharpening a blade, which has at least one cutting edge, has an elongated body with a guiding channel where the blade can be inserted therethrough and guide the sharpener along the blade side walls during sharpening. The elongated body has a chamber dimensioned to house and hold an elongated abrasive member. A portion of the abrasive member is exposed through the channel to enable the blade edge to engage the abrasive member. The chamber also has a space to capture the blade filings or fragments. A movable guide having another channel is pivotally secured to the body such that the guide can pivot relative to the body. The movable guide channel remains always aligned with the guiding channel of the body such that the body housing the abrasive member can rotate relative to the movable guide, the channel of which engages the blade, to enable the sharpener to move around a curved portion of the blade during sharpening while the abrasive member is positioned at a proper angle relative to the curved portion of the blade.

33 Claims, 13 Drawing Sheets

PORTABLE SHARPENER

This is a continuation-in-part of application Ser. No. 07/950,851 filed on Sep. 25, 1992, now U.S. Pat. No. 5,381,629, which is incorporated herein by reference.

FIELD OF THE INVENTION

The present invention relates to a portable sharpener for a blade of the type comprising at least one cutting edge (preferably two parallel cutting edges) immovably attached to a main portion of the blade and at least one end portion (preferably two end portions), the end portion(s) extending said main portion and being substantially curved. Preferably, the blade is the one of an iceskate, especially of a hockey state.

DESCRIPTION OF THE PRIOR ART

Portable sharpeners of the prior art, in particular those of the type described in the published Canadian patent application No. 2,043,165, have the disadvantage of having few stability when sharpening end portions of a blade, on one hand, as a result of the large span between the leaning points, and, on the other hand, as a results that those leaning points are located on the ends of the blade to be sharpened. Furthermore, the sharpener described in the published Canadian patent application No. 2,043,165, on one hand, requires the use of a cumbersome follower member, and, on the other hand, allows to sharpen the cutting edge(s) of the blade in a same direction, according to the prescribed art for an adequate sharpening with a file (the bite of a file in one direction is different from the one in an opposite direction), only at the expense of laborious stops by which it is necessary to mount and dismount the abrasive member and the neutral member for interchanging them.

Thus, there exists a need for a portable sharpener allowing with a reduce number of very simple and not laborious steps, to proceed with the sharpening of a blade of the type comprising a main portion provided with one or several cutting edges and one or two end portions each provided with one or several cutting edges, while keeping said cutting edges correctly aligned with an abrasive surface of said sharpener. Such an alignment allows to obtain a continuity between cutting edges of different portions of the blade.

SUMMARY OF THE INVENTION

The present invention has for object a portable sharpener for blade of the type comprising a main portion provided with one or several cutting edges and one or two end portions each provided with one or several cutting edges, that is efficient to sharpen the whole blade.

The invention has also for object a portable sharpener for blade of the type defined previously, that is very simple to use, cheap to manufacture and long lasting.

The invention has also for object a portable sharpener that allows when the abrasive surface used belongs to a file, to sharpen the cutting edge(s) of a blade in a same direction (to thus respect a well known requirement in the field of sharpening) without being obliged to resort to laborious steps for modifying the orientation of the file.

The invention has furthermore for object a sharpener where the orientation of the abrasive member with respect to the cutting edge(s) of the blade is obtained by a mere positioning generated by the contact of an abrasive member (which may be a stone or a file) with the cutting edge(s) of the blade, as far as the abrasive member is maintained parallel to said cutting edge(s).

The present invention has for object a portable sharpener where guiding means do not interfere with the position of said sharpener along the cutting edges of a blade while keeping said sharpener align with said blade.

The present invention has also for object a portable sharpener where guiding means may be moved easily (under a light pressure) with respect to the longitudinal axis of said sharpener without interfering with the position of said sharpener along the cutting edges of a blade and while keeping said sharpener align with said blade.

The invention also relates to a portable sharpener where different portions of the abrasive surface may be engaged against the cutting edges near an end of the blade. Of course, the expression different portions of the abrasive surface also comprises the possibility of using different longitudinal portions of the abrasive member.

More particularly, the present invention relates to a portable sharpener for blade of the type comprising a main portion provided with one or several cutting edges and one or two end portions each provided with one or several cutting edges, said main portion having parallel lateral faces and one or several cutting edges substantially straight or slightly curved and when more than one cutting edge is provided, said cutting edges being substantially parallel between them, each of end portions extending one corresponding end of the main portion and each having lateral faces parallel and coplanar with those of the main portion and having one or several cutting edges substantially curved, said sharpener comprising a body having a main longitudinal axis, a housing and including:

- a first member having a longitudinal axis and at least one abrasive surface parallel to said longitudinal axis and to the longitudinal axis of the body, said first member being positioned inside the housing;
- means for fastening the first member inside the housing;
- guiding means allowing a portion of the cutting edge(s) of the blade to be moved against an abrasive surface of the first member and along the longitudinal axis of said first member;
- means for recovering the fragments obtained during the sharpening of the blade, said means being located between said guiding means and the abrasive surface of the first member; and
- means for moving at least a portion of the guiding means parallel to lateral faces of the blade and maintaining these latter between said guiding means.

Advantageously, the first member may be mounted inside the housing by any appropriate fastening means.

BRIEF DESCRIPTION OF THE DRAWINGS

The present invention will be better understood with the following description of preferred aspects of this one, made with reference to the following drawings.

DESCRIPTION OF PREFERRED EMBODIMENTS OF THE INVENTION

Figure 1:
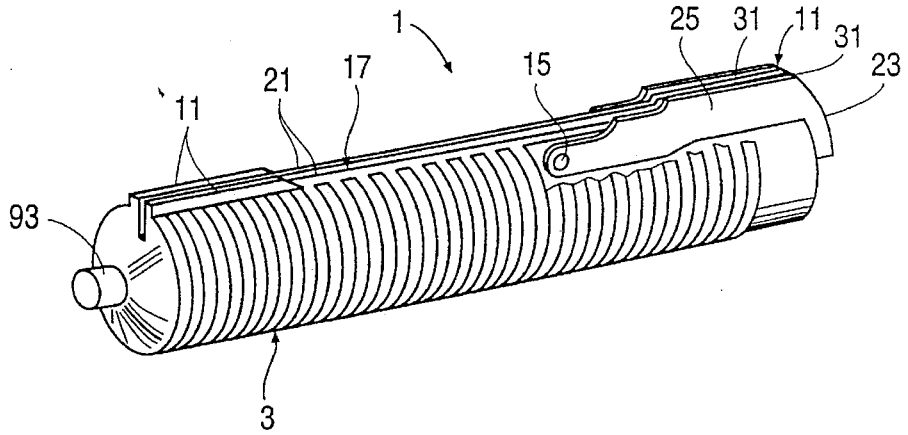
FIG. 1 represents a perspective view of a sharpener making the object of the invention.
Figure 2:
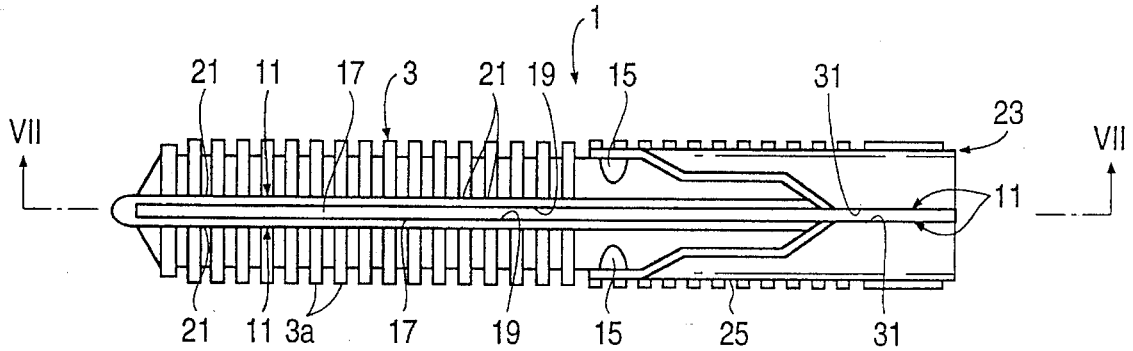
FIG. 2 represents a plane view of the underneath of the sharpener of FIG. 1.
Figure 3:
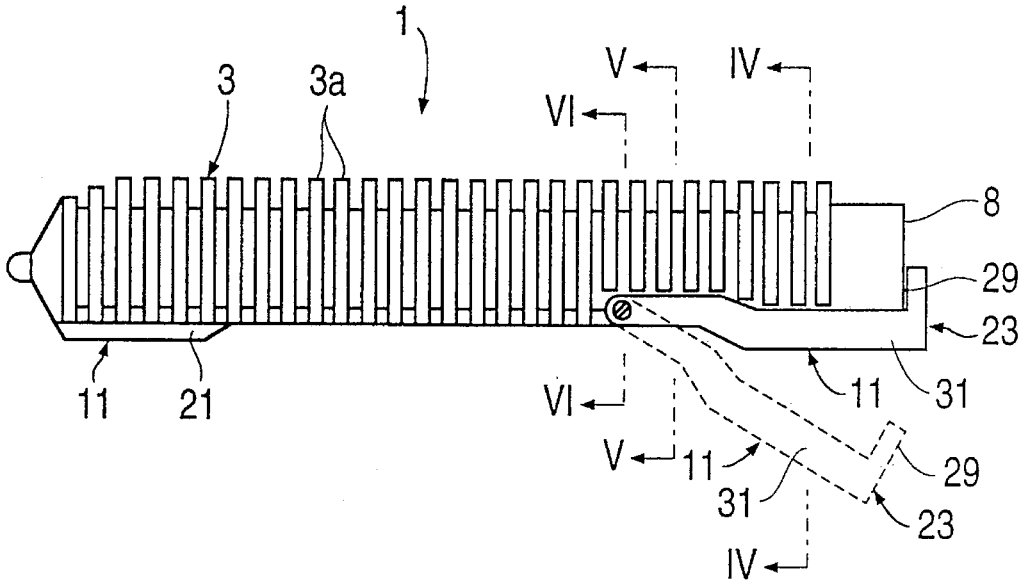
FIG. 3 represents a side elevational view of the sharpener of FIG. 1 (with the second member shown in two distinct positions, one position in full lines and another position in dotted lines)
Figure 4:
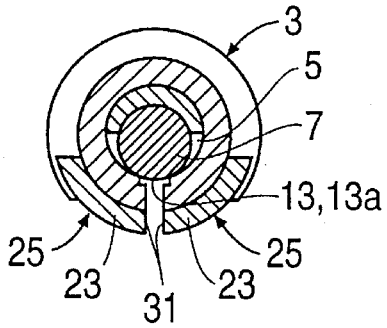
FIG. 4 represents a cross-sectional view according to line IV—IV of the sharpener of FIG. 3.
Figure 5:
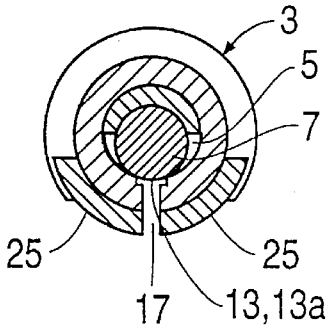
FIG. 5 represents a cross-sectional view according to line V—V of the sharpener of FIG. 3.

Referring to FIGS. 1 to 8*e*, 8*g* to 8*m*, 13 to 15, and 19 to 21, the invention relates to a portable sharpener 1 intended to be used for sharpening a blade B of the type comprising a main portion MP which may be provided with one or several cutting edges CE and one or two end portions EP each of which may be provided with one or several cutting edges CE'. Preferably, as illustrated in FIGS. 13 to 15, and 19 to 21, the blade B comprises a main portion MP provided with two cutting edges CE and two end portions EP each provided with two cutting edges CE'. The main portion MP has parallel lateral faces LF and the cutting edges CE are substantially straight or slightly curved, said cutting edges CE being substantially parallel between them. Each of end portions EP extends one corresponding end of the main portion MP and each have lateral faces LF' parallel and coplanar with those of the main portion MP and have their cutting edges CE' substantially curved.

The sharpener 1 comprises a body 3 having a main longitudinal axis, a housing 5 and including:

a first member 7 having a longitudinal axis and at least one abrasive surface 9 parallel to said longitudinal axis and to the longitudinal axis of the body 3, said first member 7 being positioned inside the housing 5;

means for fastening the first member 7 inside the housing 5;

guiding means 11 allowing a portion of the cutting edge(s) CE or CE' of the blade B to be moved against the abrasive surface 9 of the first member 7 and along the longitudinal axis of said first member 7;

means 13 for recovering the fragments obtained during the sharpening of the blade B, said means 13 being located between said guiding means 11 and the abrasive surface 9 of the first member 7; and means 15 for moving at least a portion of the guiding means 11 parallel to lateral faces LF and/or LF' of the blade B and maintaining these latter between said guiding means 11.

Advantageously, the outer surface of the body may be provided with a plurality of ribs 3*a* making easier for gripping.

According to a particularly preferred embodiment, as illustrated in FIGS. 1 to 8*e* and 13 to 15, the guiding means 11 comprise:

a longitudinal slot 17 provided in the body 3, having a pair of parallel banks 19 defining a determined width of said slot 17, said longitudinal slot 17 giving access to the housing 5 and extending parallel to the longitudinal axis of the body 3 and substantially along the whole length of said body 3;

at least one optional pair of parallel rails 21 having a determined height and length, being at a determined distance from each other and being respectively an integral part of at least a portion of one corresponding bank 19;

a second member 23 provided with a pair of arms 25 having opposite ends, said arms 25 being spaced apart at such a distance from each other that they never cover the longitudinal slot 17, and that at least a portion thereof defines a pair of banks 31 having at least a portion thereof substantially aligned with banks 19, one end of each of said arms 25 being pivotally mounted on the body 3 while the opposite end of said arms 25 is solidly fastened to a third member 29 which is maintaining the space between said arms 25, said third member 29 being positionable beyond one end of the body 3, and a sliding surface 33 which is part of said third member 29, and preferably is defined by the bottom 35 of a groove 37 provided in said third member 29.

The means 15 for moving at least a portion of the guiding means 11 parallel to lateral faces LF and LF' may comprise aforesaid second member 23 where each end of said arms opposite the ones solidly fastened to the third member 29 is pivotally mounted on the body 3 around a pivoting axis of said body, said pivoting axis being at right angles with respect to the longitudinal slot 17. More particularly, this second member 23 is movable around the pivoting axis between a first and a second positions. The first position is defined when each bank 31 are substantially parallel with the longitudinal axis of the body 3 and are substantially longitudinally extending a corresponding bank of the body 3, and when the sliding surface 33 of the third member 29 is not lower than the abrasive surface 9 of the first member 7. The second position is defined when the banks 31 are at an angle with respect to the longitudinal axis of the body 3.

It is advantageous to have a low height for banks 19, 31 (e.g. to avoid interferences with structural members SM and/or protection member PM and especially to allow the sharpening of worn blades showing a small distance between structural or protection members and the cutting edges). However, the surface of banks 19, 31 against corresponding lateral faces LF and/or LF's is reduced and this may cause, especially where the cutting edges are curved, a misalignment of the blade B in the longitudinal slot 17. Therefore, to avoid such an eventual problem, it may be preferred that the height of at least a portion of the pair of banks 19 be extended with banks 20 of rails 21 and a portion of banks 31 be extended by a thickening of the third member 29 to increase the length of the groove 37. These preferred characteristic contributes to improve the positioning of the blade B in the longitudinal slot 17 and against the abrasive surface 9.

According to a particularly preferred variant of the invention, as illustrated in FIGS. 8*g* to 8*m* and 19 to 21, the guiding means 11 may comprise:

a longitudinal slot 17 provided in the body 3, having a pair of parallel banks 19 defining a determined width of said slot 17, said longitudinal slot 17 giving access to the housing 5 and extending parallel to the longitudinal axis of the body and substantially along the whole length of said body;

optionally a pair of parallel rails 21' having a determined height and length, being at a determined distance from each other and each defining a bank extending a corresponding bank of the longitudinal slot and wherein the height of at least a portion 22' of the pair of rails 21' has a reduced height;

a second member 23' provided with a pair of arms 25' having opposite ends, said arms 25' being spaced apart at such a distance from each other that they never cover the longitudinal slot 17, one end of each arm 25' being pivotally mounted on the body 3 while the opposite end of each of said arm 25' is solidly fastened to a third member 29' which is mountaining the space between said arms 25', said third member 29' being provided with a pair of opposed guiding means such as grooves 37' which are respectively defining a pair of banks 31' that are substantially co-planar with banks 19 of the longitudinal slot 17 of the body 3; and a sliding surface 33' for each groove 37' of the third member 29'. Preferably, the sliding surface 33' is defined by the bottom of said groove 37'. Optionally, the groove 37' may be provided at the bottom of a large groove 38.

Advantageously, the rail 21' has a portion 22' of reduced height for avoiding interference with structural members SM and/on protection member PM and/or to allow the sharpening of worn blades showing a small distance between the structural members or protection members and the cutting edges.

The means 15 for moving at least a portion of the guiding means 11 parallel to lateral faces LF and LF' may comprise aforesaid second member 23' where each end of said arms 25' opposite the ones fastened to the third member 29', is pivotally mounted on the body 3 around a pivoting axis of said body, said pivoting axis being at right angle with respect to the longitudinal slot 17.

More particularly, this second member 23' is movable around the pivoting axis between a first or a second position and an intermediary position, the first and second positions being defined when each bank of the third member 29' are substantially parallel with the longitudinal axis of the body and are substantially longitudinally extending a corresponding bank 19 and the sliding surface 33' of the corresponding groove 37' is not lower than the abrasive surface 9 of the first member 7. The intermediary position is defined when banks of the third member 29' are at an angle with respect to the longitudinal axis of the body 3.

Advantageously, as illustrated in FIGS. 1 to 8*e* and 13 to 15, means 39 may be further provided for removing barbs 41 that may be created during the sharpening of the cutting edges CE and/or CE'. Preferably, such means 39 may comprise in each lateral banks 36 of the grooves 37 of the third member 29, each of said banks 36 extending a corresponding bank 31, a small housing 43 and a member 45 having at least one abrasive surface 47, preferably a whetstone positioned in each small housing 43 in such a way to have its abrasive surface 47 intended to contact a corresponding lateral face LF and/or LF' of the blade B and remove barbs that may be created during the sharpening of the cutting edges CE and/or CE'. Alternatively, said small housings 43 and members 45 may be provided in a portion of greater height of banks 20 of rails 21, said banks 20 respectively extending a corresponding bank 19 of the slot 17.

Of course, the member 45 which is preferably a whetstone may be mounted in the housing 43 by any appropriated means, such as gluing.

Of course, the width between banks 19, 20, 31 and 36 is not lesser than the thickness of a blade B and preferably the width between banks 20, 27 and 36 is smaller to the one between banks 19 of the longitudinal slot 17. Optionally, means may be provide to vary the distances between banks 20, 27 and/or 36 to thus enlarge the width between them and allow the sharpening of blades of various thickness.

Figure 6:
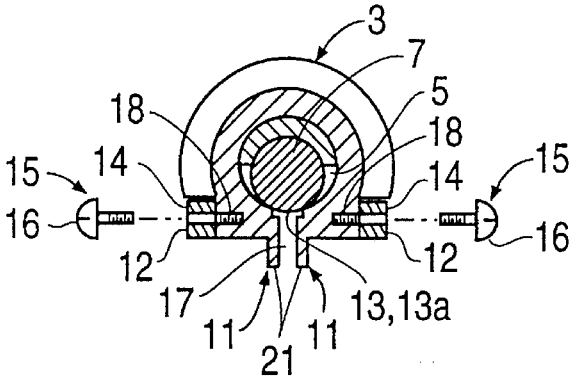
FIG. 6 represents a cross-sectional view according to line VI—VI of the sharpener of FIG. 3.

Advantageously, means for pivotally mounting the second member 23 or 23' on the body 3 may comprise a pair of bore 18 co-axial with the pivoting axis of the body 3 and provided in said body, an opening 14 provided near one end of each arm 25 or 25' and a pair of pivoting rod, especially a bolt 16. Each bolt 16 engage one opening of one arm 25 or 25' and a corresponding bore 18. Preferably, the bore and the bolt are threaded and engaged one into the other. Optionally, as illustrated in FIG. 6, each opening 14 may rest on a corresponding shoulder 12. Of course, any equivalent means may be used.

Advantageously, the body 3 may be further provided with an end opening 6 substantially co-axial with the longitudinal axis of the body and giving access to the housing 5 and allowing to introduce the first member 7 in the housing 5. Preferably, a removable cap 8 may be further provided to cover completely or in part this end opening.

According to a particularly preferred embodiment, the end opening 6 has the same cross-section than the inside of the housing 5, and preferably both are at least slightly larger than the cross-section of the first member to avoid the abrasive surface 9 to damage the housing during its introduction in said housing.

According to a particularly preferred embodiment, means may be provided to fasten the cap on the body 3. As it is illustrated in FIGS. 1 to 8*e* of the drawings, such means may consist of a shoulder having an outer surface 2 of a given shape and provided at the end of the body 3 where the end opening 6 is provided, and an inner cavity 4 in said cap 8, said cavity having a surface 4*a* that fits with at least a portion of said outer surface 2. The mounting and removal of said cap 8 on said shoulder may be obtained when we push or pull the cap 8 on said shoulder, the cap 8 being held in place by the mere friction existing between surfaces of said shoulder and cap.

According to a particularly preferred embodiment of the invention, means may be further provided to removably lock the second member 23 in a position where bank 31 are substantially parallel with banks 19. Such means may comprise, as it is illustrated in FIGS. 1 to 8*e*, a small protuberance 23*a* positioned on the cap 8 and a small cavity 23*b* positioned on the third member 29, said protuberance 23*a* being engaged in said cavity 23*b* when banks 31 are substantially parallel with banks 19. Of course, the third member 29 has to be slightly bent to remove or introduce the protuberance 23*a* from the cavity 23*b*. Such a deformation is obtained when said member 23 is forced to be pivoted around the pivoting axis of the body 3.

Similar means may be provided to removably lock the second member 23' in a position where banks 36' are substantially parallel with banks 19. Optionally, in this latter case, said means may be provided at both ends of the body 3.

Advantageously, the first member 7 may consist of a whetstone, (especially a cylindrical whetstone), of a file (especially a file made of steel), of a member consisting of an elongated member that is fitted out with one or several abrasive member having abrasive surfaces of identical or distinct shape. Optionally, the first member 7 may consist of an elongated member on which is mounted by any appropriated means such as fluing, a sheet of abrasive material. The elongated member may be made of any appropriate material, in particular of plastic material.

The first members 7 may be mounted inside the body 3 by any appropriate fastening means, especially those of the type described hereinafter.

Figure 7:
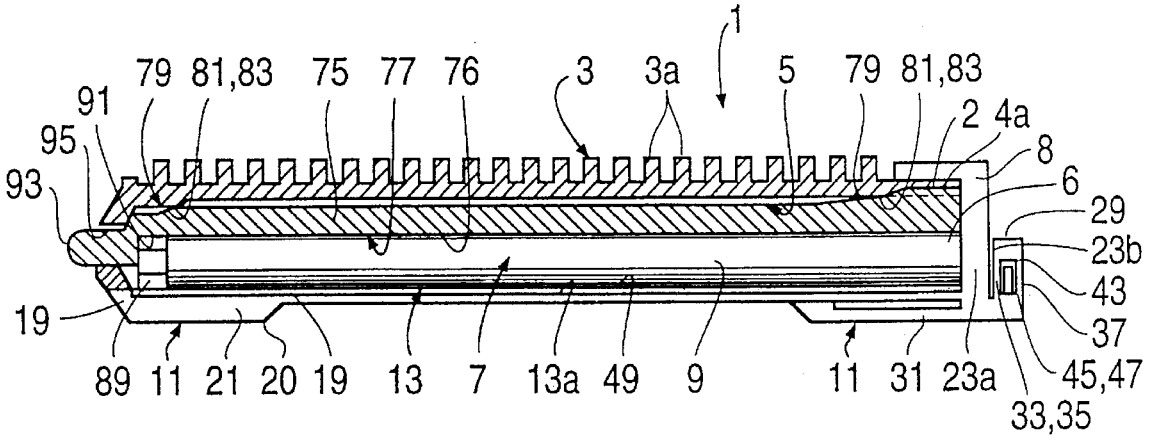
FIG. 7 represents a longitudinal cross-sectional view according to line VII—VII of the sharpener of FIG. 2.
Figure 7A:
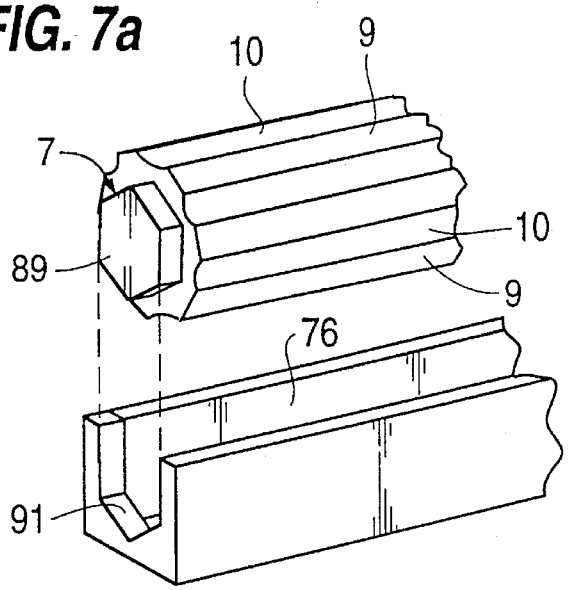
FIG. 7*a* represents a partial perspective view of a first member and of an elongated support.

Preferably, the first member 7 consists of a stone provided as illustrated in FIG. 7*a*, with several abrasive surfaces 9 separated from each other by a groove 10.

Figure 7B:
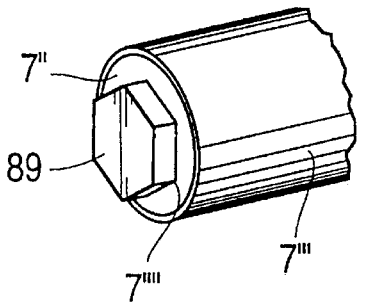
FIG. 7*b* represents a partial perspective view of an optional first member that may replace the first member of FIG. 7*a;*

Alternatively, with reference to FIG. 7*b*, the first member 7 may be replaced by a first member 7' comprising an elongated member 7", a sheet of abrasive material 7'" and a layer of glue 7"" joining the sheet 7'" on the outer surface of the elongated member 7". Advantageously, the sheet of abrasive material may be a sandpaper of the type already available on the market.

According to a preferred embodiment of the invention the fastening means may consist of an elongated support 75 having a longitudinal axis and opposite ends, said support 75 being further provided with means 77 for receiving the first member 7 and means 79 for pressing one abrasive surface 9 of the first member 7 against the floor 49 of the housing 5 and vis-à-vis the longitudinal slot 17 of the body 3. Preferably, said means 77 for receiving the first member 7 comprise a longitudinal cavity 76 where the first member 7 is partly housed.

According to a particularly preferred embodiment of the invention said means 77 for pressing one abrasive surface 9 of the first member 7 against the floor 49 of the housing 5 and vis-à-vis the longitudinal slot 17 of the body 3 comprise a pair of inclined faces 81 respectively provided near both ends of the housing 5 and a pair of inclined faces 83 respectively provided near each end of the support 75, said inclined faces 81, 83 being so positioned that when the support 75 is introduced in the housing 5 through the end opening 6 and according to an axis substantially parallel with the longitudinal axis of the body 3, said opening 6 giving access to the inside of the housing 5, they come into mutual contact and move the support 75 toward the floor 49 of the housing 5 and thereby press one abrasive surface 9 of the first member 7 against said floor 49 vis-à-vis the longitudinal slot 17 of the body 3, the friction between said inclined faces 81, 83 being sufficient to removably lock the first member 7 inside the housing 5.

According to a particularly preferred embodiment of the invention, when the first member 7 may have several abrasive surfaces 9, said means 77 may be further provided with means allowing to position the first member 7 around its longitudinal axis and selectively position one of said abrasive surfaces 9 vis-à-vis the longitudinal slot 17. Advantageously, said means 77 may comprise a polygonal member (preferably an hexagonal member) 89 making an integral part of at least one end of the fist member 7 and a corresponding recess 91 provided in the cavity 76 of the first support 7. Advantageously, said abrasive surfaces 9 may be separated from each other by a longitudinal groove 10.

According to a preferred embodiment of the invention, means may be further provided to make easier the removal of the first member 7 from the housing 5. Preferably, as it is illustrated in FIGS. 1 to 7, and 8*g* to 8*m* such means may comprises an elongated pin 93 immovably attached to one end of the elongated support 75, and a small opening 95 positioned in one end of the body 3 opposite the end opening, said pin 93 and small opening 95 being co-axial. When the elongated support 75 is positioned inside the housing and pressed the abrasive surface 9 against the floor 49 of the housing 5 and the longitudinal slot 17, said pin 93 projects through the small opening 95, out of the body 3.

In the case of the sharpener illustrated in FIGS. 8*g* to 8*m* and 19 to 21 the pin 93 is advantageously flush with the opening 95 to avoid interference with the third member 29'.

For introducing the first member 7 in the housing 5 and pressing one of the abrasive surface 9 against the floor 49 and vis-à-vis the longitudinal slot 17, one only has to slide the elongated support 75 together with the first member 7 in the housing 5 through the end opening 6 (after having remove the cap 8 and move away the third member 29), until surfaces 81, 83 come into mutual contact and the pin 93 engages the small opening 95, and then to press surfaces 81, 83 one against the other to move the abrasive surface against the floor 49 and vis-à-vis the longitudinal slot 17. Then the cap 8 is remounted on the body 3.

For removing the first member 7 from the housing 5, the cap is removed by pulling, and a pressure is applied against the pin 93 to move the elongated support 75 and the first number 7 and separate surfaces 81, 83. Then the elongated support 75 and the first member is grasped and completely removed from the housing 5 through the end opening 6. Of course, the third member 29 is moved away in order to not interfere with the removal of the elongated support and first member.

For changing the abrasive surface intended to be pressed against the floor 49 and vis-à-vis the longitudinal slot 17, one only has to grasp the first member 7 and remove it from the cavity 76 and put it back in said cavity after having rotated it around its longitudinal axis to have a new abrasive surface intended to face said floor 49 and vis-à-vis the longitudinal slot 17. The exact positioning of the surface 9 is obtained when an edge of the hexagonal member is engaged in a corresponding recess 91.

Figure 8:
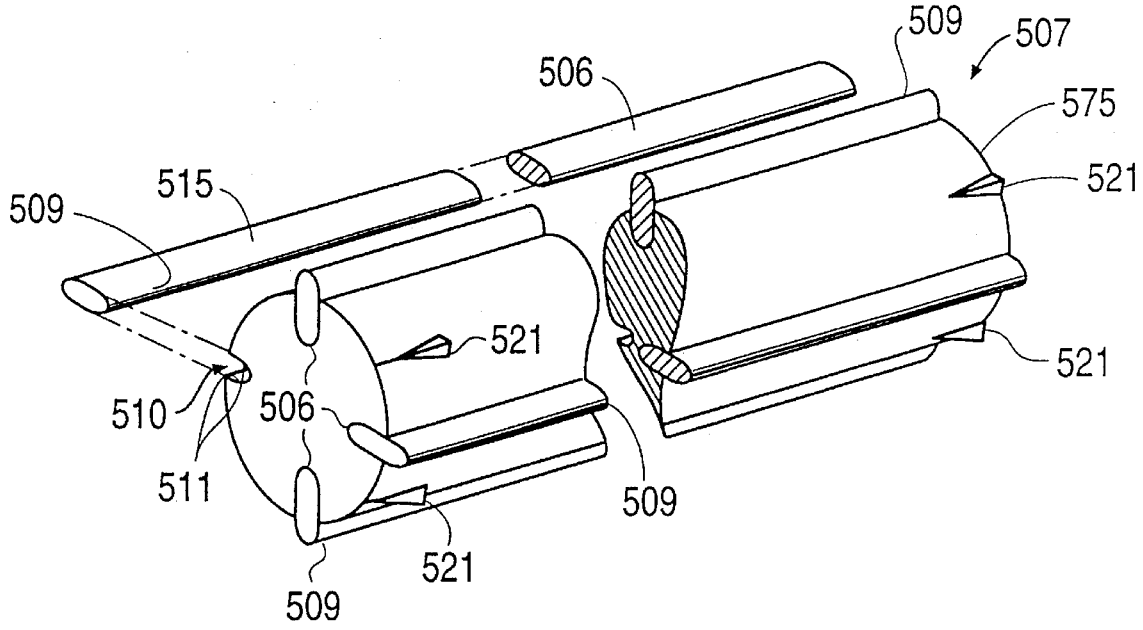
FIG. 8 represents a perspective view of a particularly preferred variant of the first member with one abrasive member removed from said elongated supporting member.
Figure 8A:
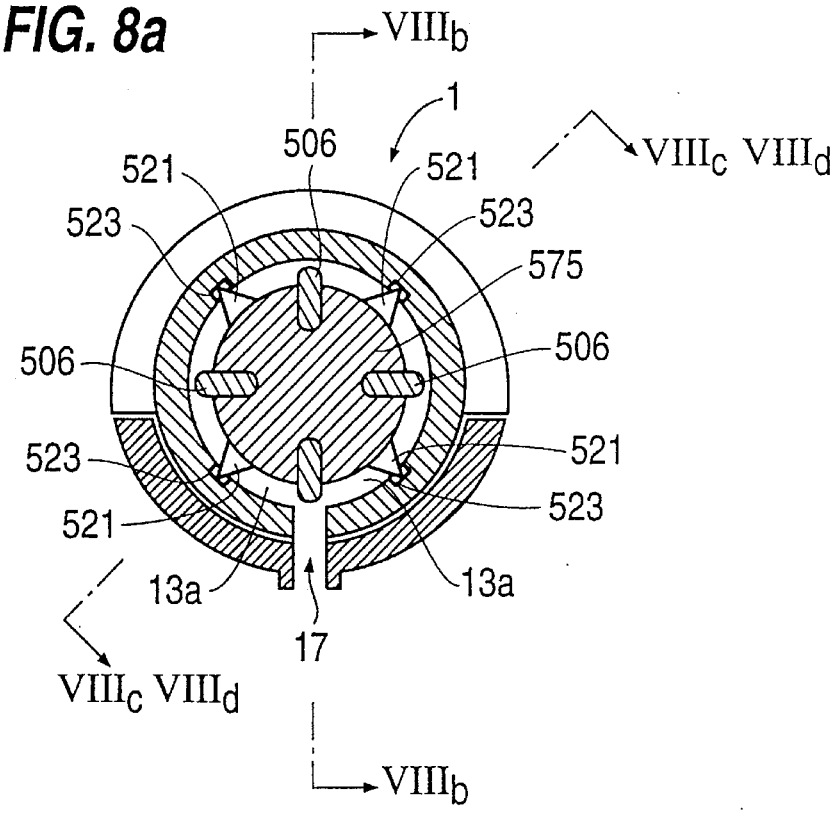
FIG. 8*a* represents a cross-sectional view according to line III—III of the sharpener of FIG. 3 except a first member of the type illustrated in FIG. 8 has been provided.
Figure 8B:
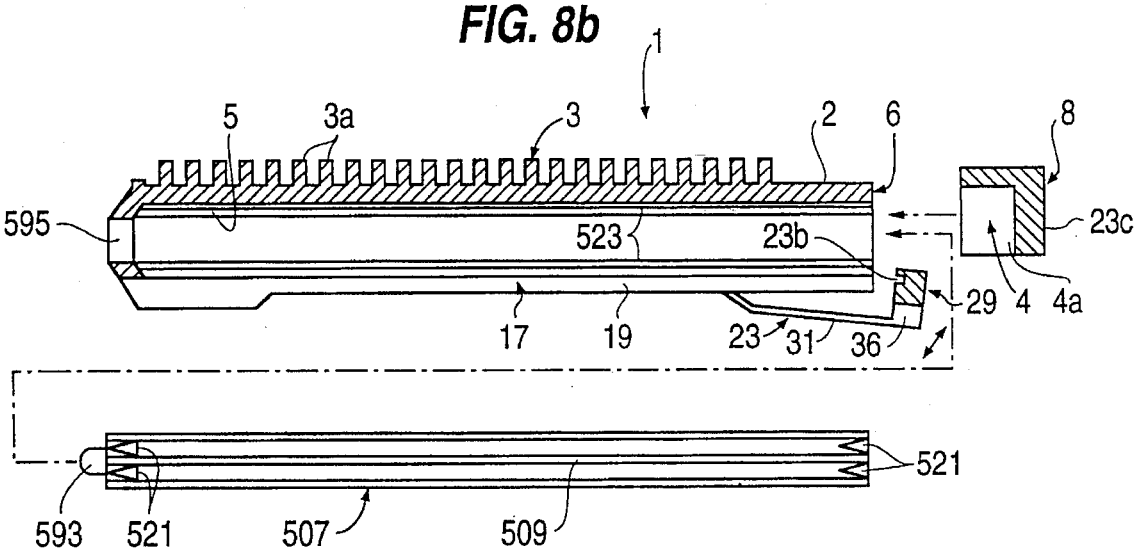
FIG. 8*b* represents a longitudinal cross-sectional view according to line VIIIb—VIIIb of the sharpener of FIG. 8*a;*
Figure 8C:
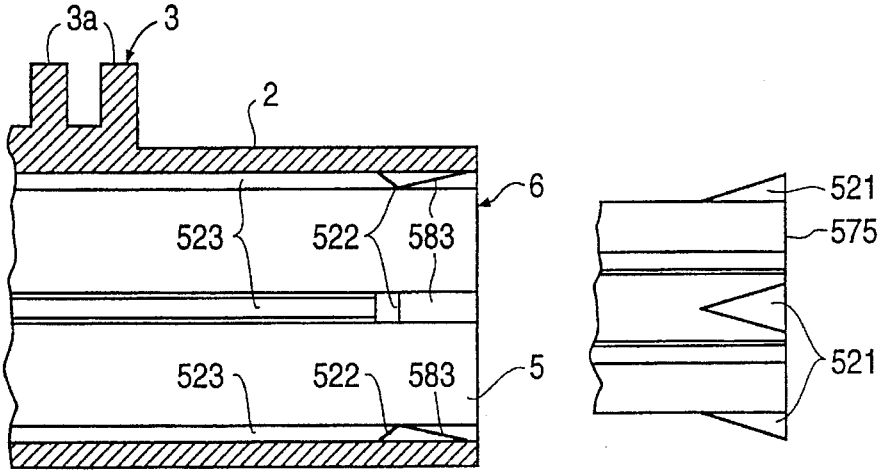
FIGS. 8*c* and 8*d* represent how each protuberance engages a corresponding groove in the housing.
Figure 8E:
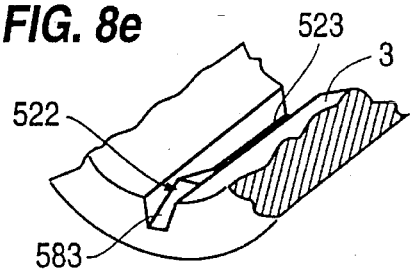
FIG. 8*e* represent details of one groove of the housing.
Figure 8D:
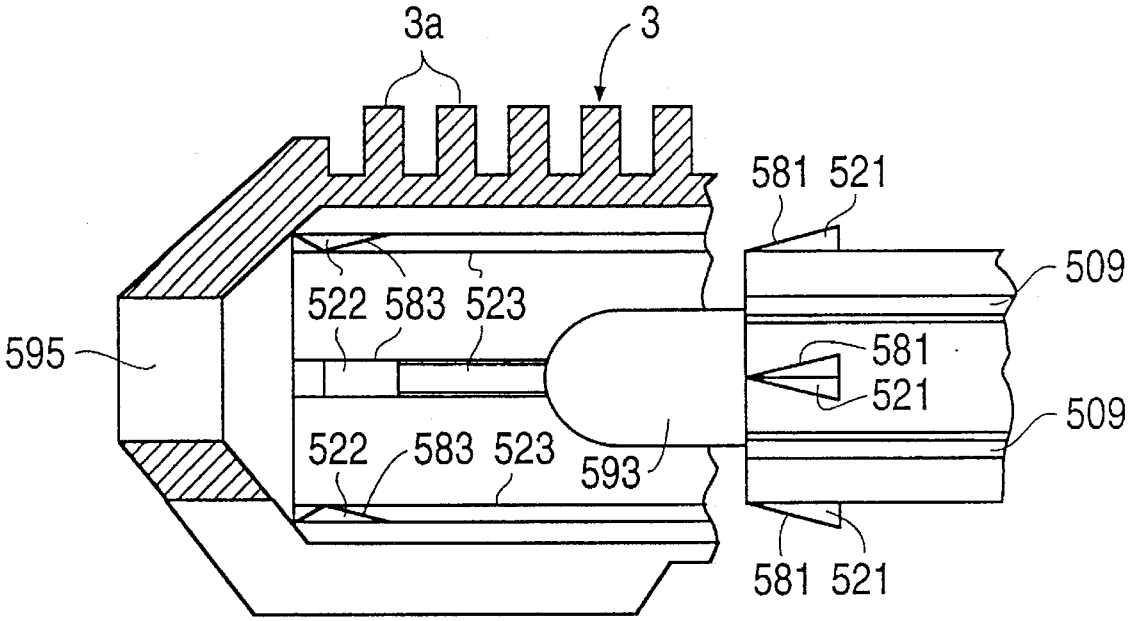

According to a particularly preferred embodiment of the invention, the first member 7 may be a first member 507 comprising, as illustrated in FIGS. 8 to 8*e*, an elongated supporting member 575, at least two abrasive members 506, preferably four abrasive members 506, each provided with at least one abrasive surface 509, means for removably fastening said abrasive members 506 on said elongated supporting member 575, and means for removably positioning one abrasive surface 509 vis-à-vis the longitudinal slot 17.

Advantageously, means for removably fastening each abrasive member 506 on said elongated supporting member 575 comprises:

a groove 510 provided in the elongated supporting member 575, parallel to the longitudinal axis of the first member 507, having a determined depth and a pair of walls 511 substantially parallel to each other and perpendicular to the longitudinal axis of the elongated member 575, an abrasive member 506 having a longitudinal axis parallel to the longitudinal axis of the first member 507, a pair of opposite lateral walls 515 parallel to its longitudinal axis and a pair of opposite abrasive surfaces 509 substantially perpendicular to the opposite lateral walls 515, said lateral walls 515 being spaced apart at such a distance from each other to contact corresponding walls 511 of the elongated supporting member 575 and said abrasive surfaces 509 being spaced apart at such a distance from each other that when one of said surface 509 is against the bottom of a corresponding groove 510 of the elongated supporting member 575, the opposite abrasive surface 509 is projecting out of said groove 510.

Advantageously, said means for removably positioning one abrasive surface vis-à-vis the longitudinal slot may comprise:

at least one protuberance 521 provided on said elongated supporting member 575, at least two grooves 523 provided in the housing 5, each groove 523 being parallel to the longitudinal axis of the body 3 and shaped to receive the above mentioned protuberance 521, said grooves 523 being spaced apart from each other in the housing 5 so that when one protuberance 521 engages one of said groove 523, one abrasive surface 509 is aligned with the longitudinal slot 17, and when the protuberance 521 engages another groove 523, another abrasive surface 509 is aligned with the longitudinal slot 17.

Advantageously, there are four grooves 523 in the housing 5 and four protuberances 521 or set of protuberances 521 provided on the elongated supporting member 575.

Advantageously, means 13 for recovering the fragments obtained during the sharpening of the blade B may consist of a second housing 13*a* located between said guiding means 11 and the abrasive surface 9 of the first member 507.

Advantageously, each protuberance 521 projects from a longitudinal outer surface of the elongated supporting member 575 at such a distance that when it is positioned against the bottom of a corresponding groove 523, the abrasive surfaces 509 do not contact the housing 5. Preferably, the distance existing between the abrasive surface 509 facing the longitudinal slot 17 is sufficient to define said second housing 13*a*. Because the abrasive surfaces 509 do not contact the housing, they do not damage it during the introduction of the first member 507 in the housing 5.

According to a particularly preferred embodiment of the invention, each protuberance 521 is wedge-shaped and for each protuberance 521 a corresponding wedge-shaped protuberance 522 is provided in the bottom of grooves 523. Preferably, protuberances 521 located near the fore-end of the first member 507 have a height slightly lower than the one located near the rear end of said first member 507 in order said protuberances 521 located on the fore-end of the first member 507 only contact the protuberances 522 located near the forepart of the housing 5.

When the first member 507 is introduced in the housing 5 by the end opening 6, protuberances 521 engage the grooves 523 until an inclined surface 581 of each protuberances 521 engage a corresponding inclined surface 583 of protuberances 522. Of course, said inclined surfaces have substantially the same angle and friction therebetween is sufficient to removably lock the first member 507 inside the housing 5.

As for the first member 7, the first member 507 may be further provided with means allowing to make easier the removal of the first member 507 from the housing 505. Such means may comprise, for example, a pin 593 immovably attached to the fore-end of the elongated supporting member 575, and a small opening 595 positioned in the forepart of the body 3, said pin 593 and small opening 595 being co-axial. When the elongated supporting member 575 is positioned inside the housing 5, and inclined surfaces of protuberances 521, 522 are pressed one against the other, the pin 593 is engages through the small opening 595, out of the body 3.

For introducing the first member 507 in the housing 5 and pressing the inclined surfaces of protuberances 521, 522 one against the other, with one abrasive surface 509 facing the longitudinal slot 17, one only has to slide the elongated support 575 in the housing 5 through end opening 6 (after having remove the cap 8 and moved away the third member 29), with protuberances 521 engaged in corresponding grooves 523, until said inclined surfaces come into mutual contact and the pin 593 engages the small opening 595, and then to press surfaces 581, 583 one against the other. Then the cap 508 may be remounted on the body 3.

For removing the first member 507 from the housing 5, the cap 8 is removed by pulling, and a pressure is applied against the pin 593 to move the elongated supporting member 575 and separate surfaces 581, 583. Then the member 575 is grasped and completely removed from the housing 5 through the opening 6. Of course the third member 29 is moved away in order not to interfere with the removal of the member 575. For changing the abrasive surface 509 intended to be faced with the longitudinal slot 17, one only has to grasp the member 575, either remove the abrasive member 506 from the groove 510 and put it back in the groove 510 after having turned it at 180°, or rotate the whole member 575 around its longitudinal axis and then put the member 575 back in the housing 5 with protuberances 521 engaged in grooves 523 to bring a brand new abrasive surface 509 vis-à-vis the longitudinal slot 17.

Figure 13:
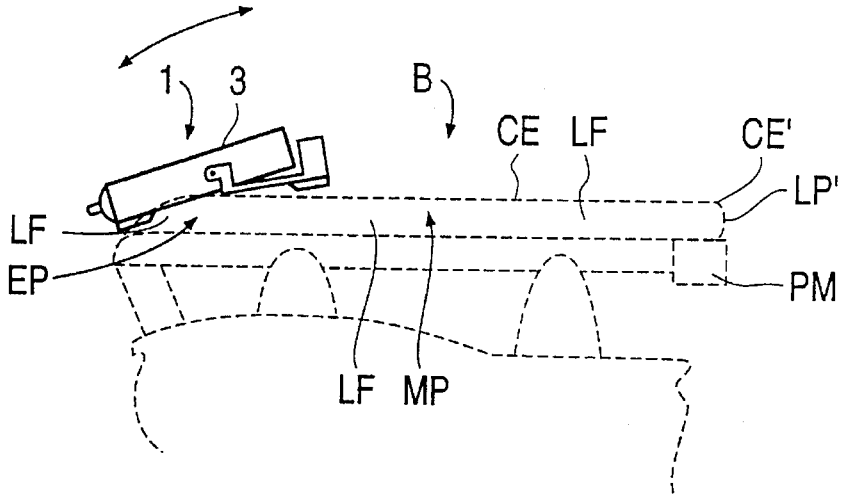
FIGS. 13 to 15 represent how the sharpener of FIGS. 1 to 8*e* is used.
Figure 14:
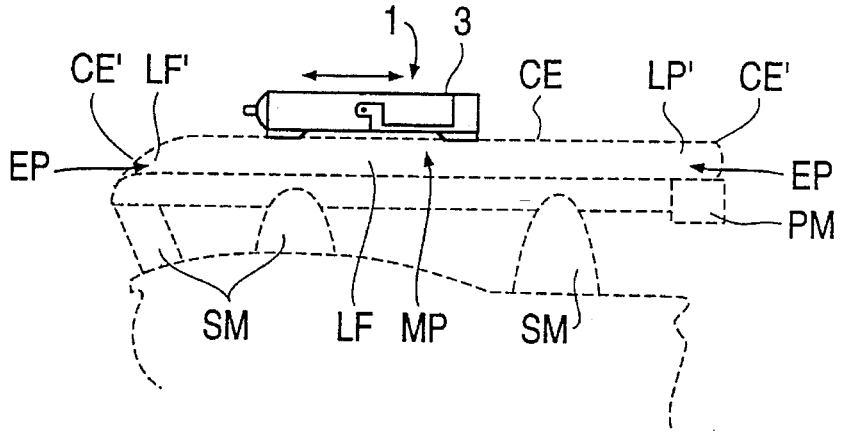
Figure 15:
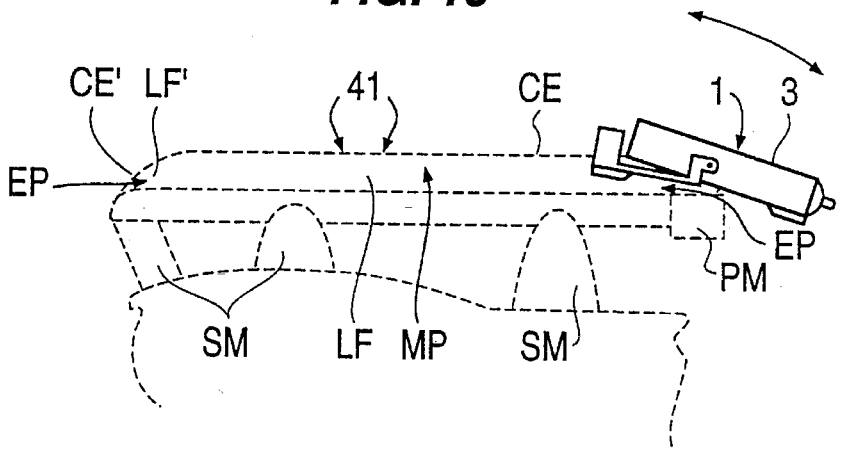

Referring to FIGS. 13 to 15, it is represented who we can use the sharpener of FIGS. 1 to 7. All what a user has to do is to move the member 23 around its pivoting axis in such a way that banks 19, 31 be facing corresponding lateral faces of the blade B. The user only have to apply a pressure of the abrasive surface 9 or 509 against cuttings edges CE and/or CE' while moving it against said cutting edges. The user just has to take care of adjusting, if necessary, the position of the second member 23 so that banks 19, 31 remain facing the lateral face to be sharpened. When the abrasive surface 9 or 509 belongs to a file, the user moves the abrasive surface 9 or 509 in a same direction from the cutting edges CE' of one end portion EP, then on the cutting edges CE of the main portion MP and then on the cutting edges CE' of the other end portion EP. However, when a whetstone if used, there is no advantage to sharpen the cutting edges in a unique direction. Of course, the above steps may be repeated until the cutting edges LE and LE' are properly sharpened.

Figure 19:
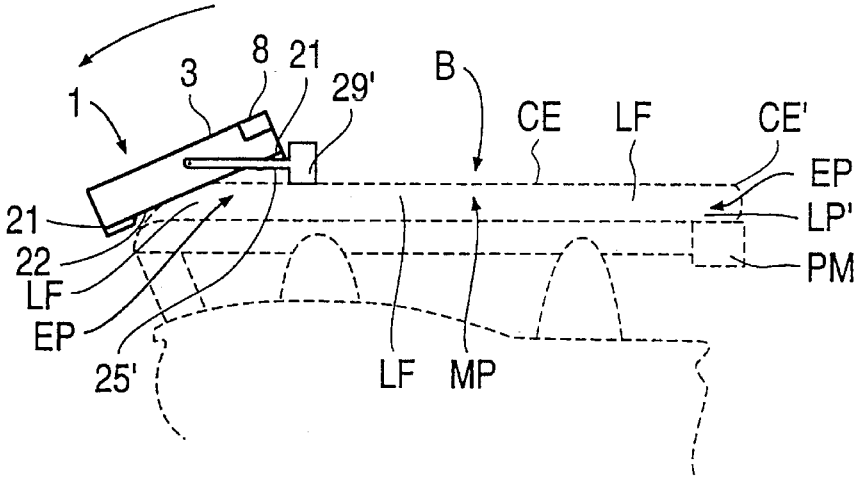
FIGS. 19 to 21 represent how the sharpener of FIGS. 8*g* to 8*m* is used.
Figure 20:
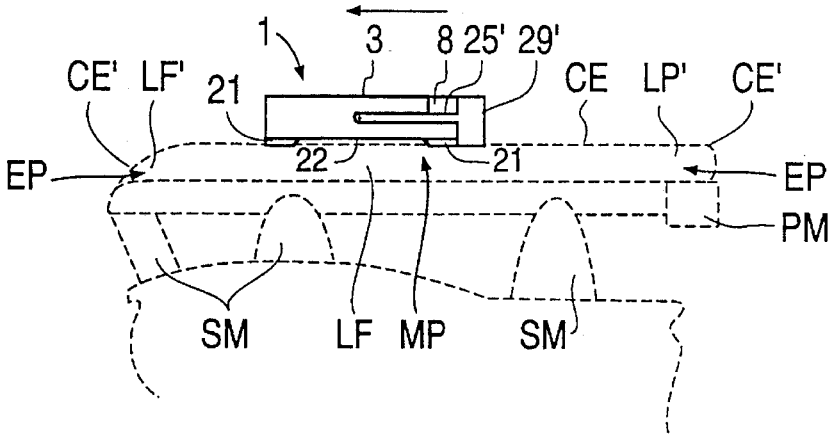
Figure 21:
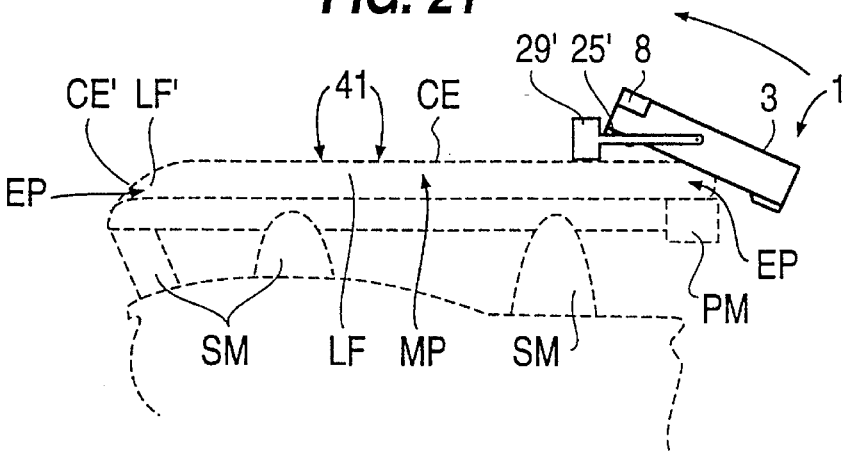

Referring to FIGS. 19 to 21, it is represented how we can use the sharpener of FIGS. 8*g* to 8*m*. All what a user has to do is to move the member 23' around its pivoting axis in such a way that banks 19 and 36' are facing corresponding lateral faces of the blade B. The user only have to apply a pressure of the abrasive surface 9 or 509 against cutting edges CE and/or CE' while moving it again the cutting edges. The user just have to take care of adjusting, if necessary, the position of the second member 23' to that banks 19 and 36' remain facing the lateral face of the blade to be sharpened.

When the abrasive surface 9 or 509 belongs to a file, the user will preferably move the abrasive surface 9 or 509 in a same direction from the cutting edges CE' of one and portion EP, then on the cutting edges of the main portion MP and then on the cutting edges of the other end portion EP. However, when a whetstone is used, there is no advantage to sharpen the cutting edges in a unique direction.

Of course, the above steps may be repeated until the cutting edges LE and LE' are properly sharpened.

Figure 8F:
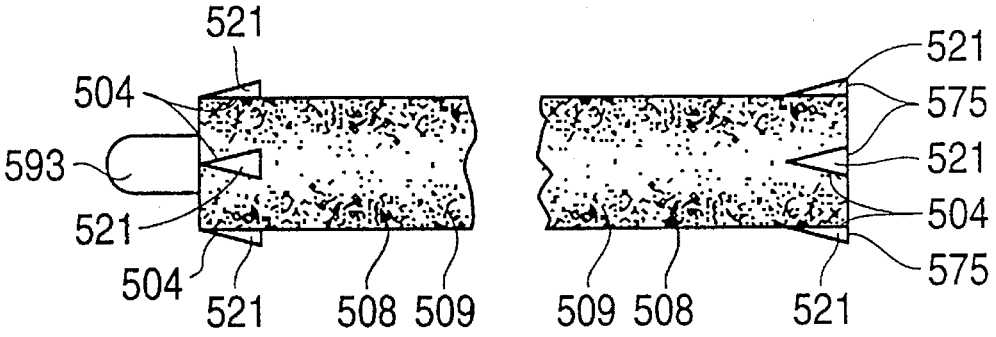
FIG. 8*f* represents a partial view of an optional embodiment of the first member shown in FIGS. 8 to 8*e;*
Figure 8G:
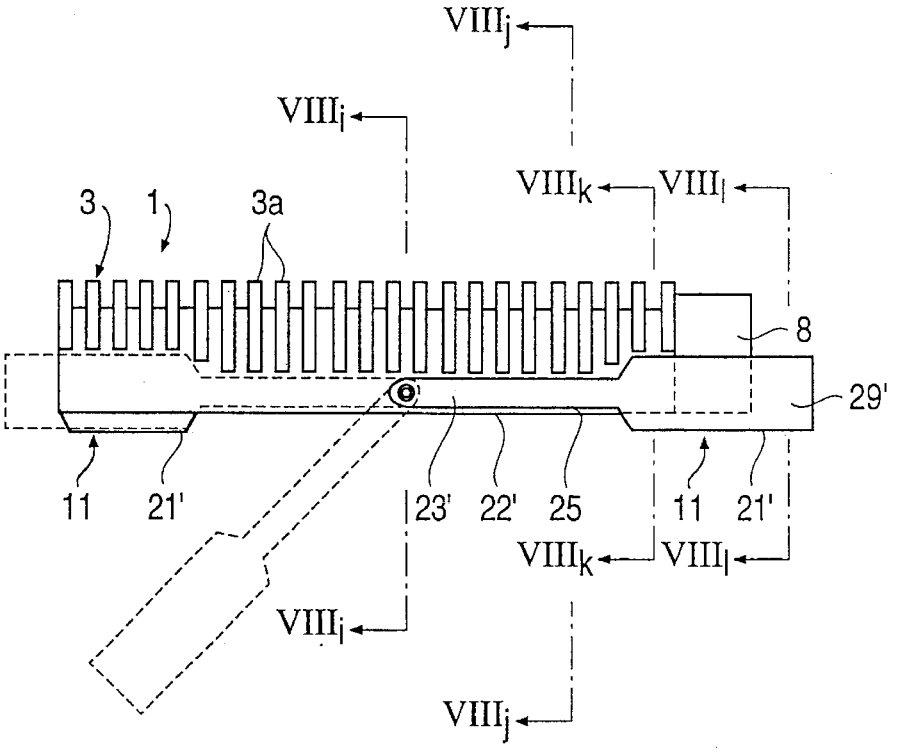
FIG. 8*g* represents a side elevational view of a particularly preferred variant of the sharpener of FIG. 1 (with the second member shown in two distinct positions, one position in full lines and another in dotted lines, and in an intermediary position in dotted lines)
Figure 8H:
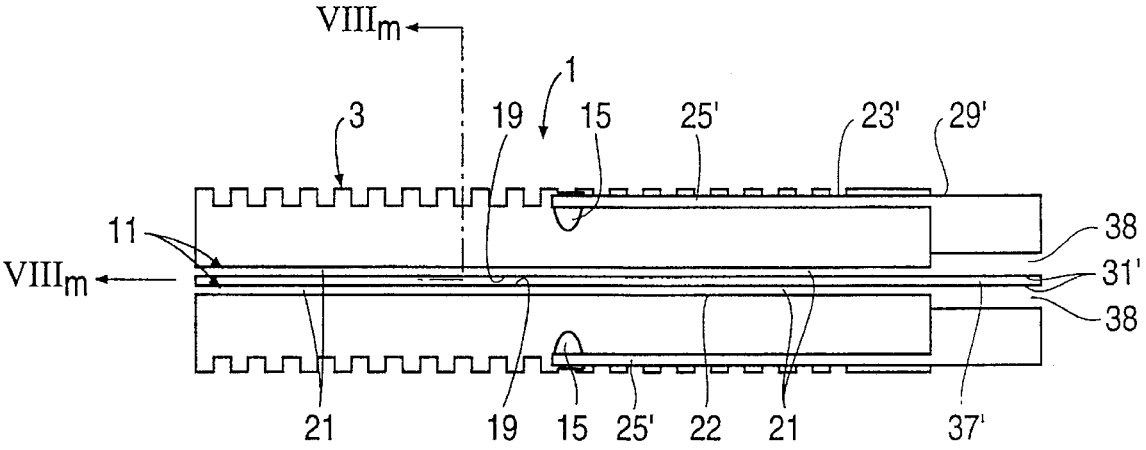
FIG. 8*h* represents a plane view of the underneath of the sharpener of FIG. 8*g;*
Figure 8I:
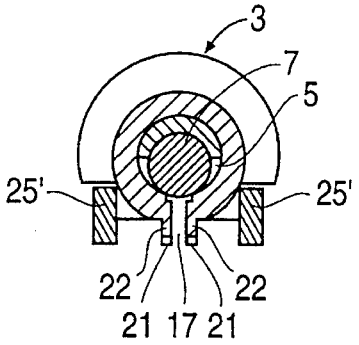
FIG. 8*i* represents a cross-sectional view according to line VIIIi—VIIIi of the sharpener of FIG. 8*a;*
Figure 8L:
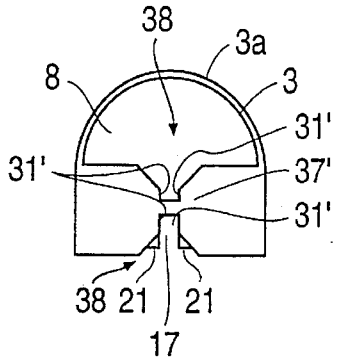
FIG. 8*l* represents a cross-sectional view according to line VIIIl—VIIIl of the sharpener of FIG. 8*g;*
Figure 8J:
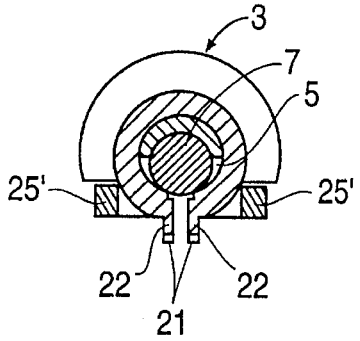
FIG. 8*j* represents a cross-sectional view according to line VIIIj—VIIIj of the sharpener of FIG. 8*g;*
Figure 8M:
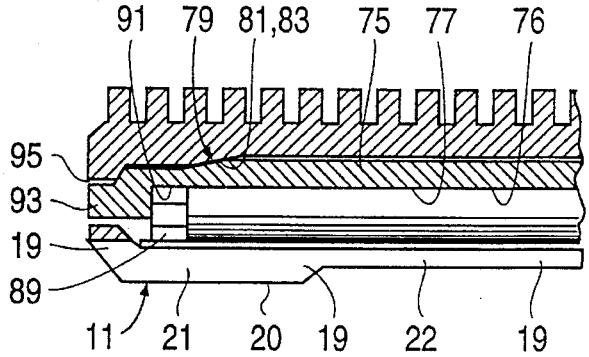
FIG. 8*m* represents a cross-sectional view according to line VIIIm—VIIIm of the sharpener of FIG. 8*h;*
Figure 8K:
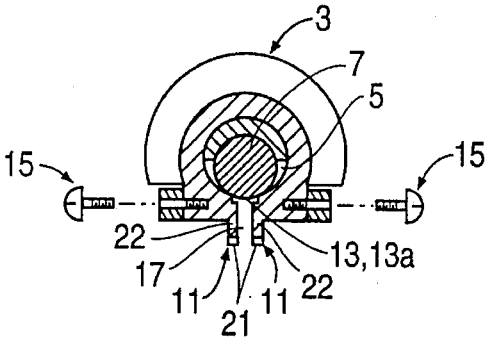
FIG. 8*k* represents a cross-sectional view according to line VIIIk—VIIIk of the sharpener of FIG. 8*g;*
Figure 9:
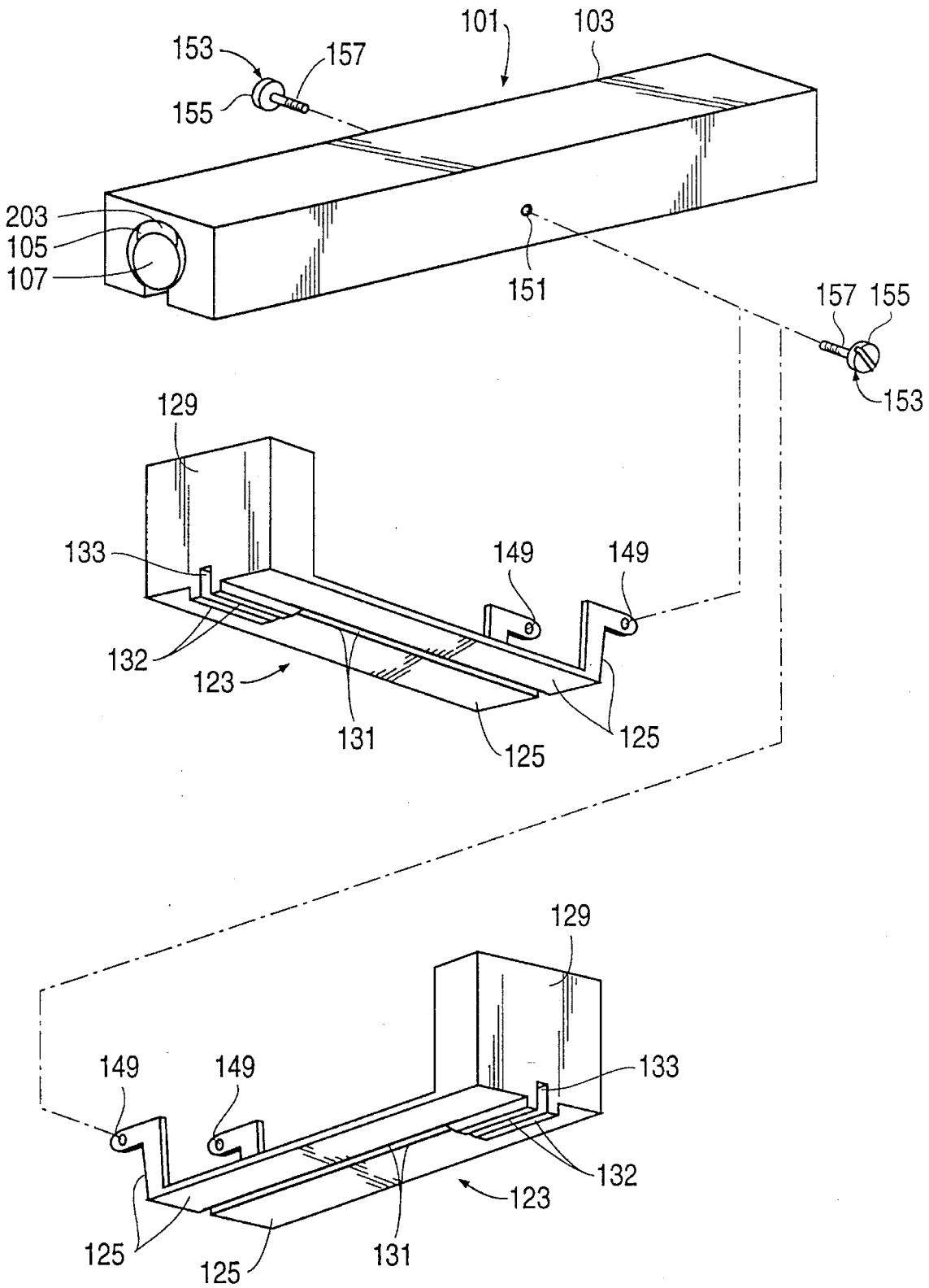
FIG. 9 represents a perspective exploded view of an optional aspect of the sharpener according to the invention.
Figure 10:
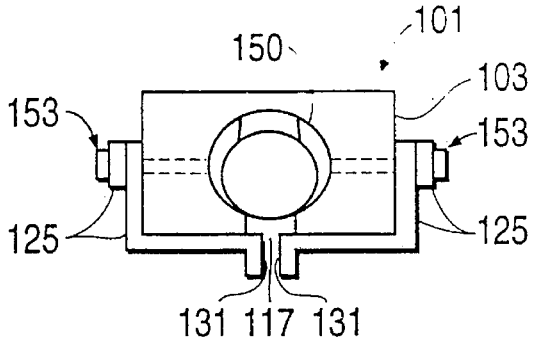
FIG. 10 represents a cross-sectional view showing the manner in which the two pivotable members are attached to the sharpener of FIG. 9.
Figure 11:
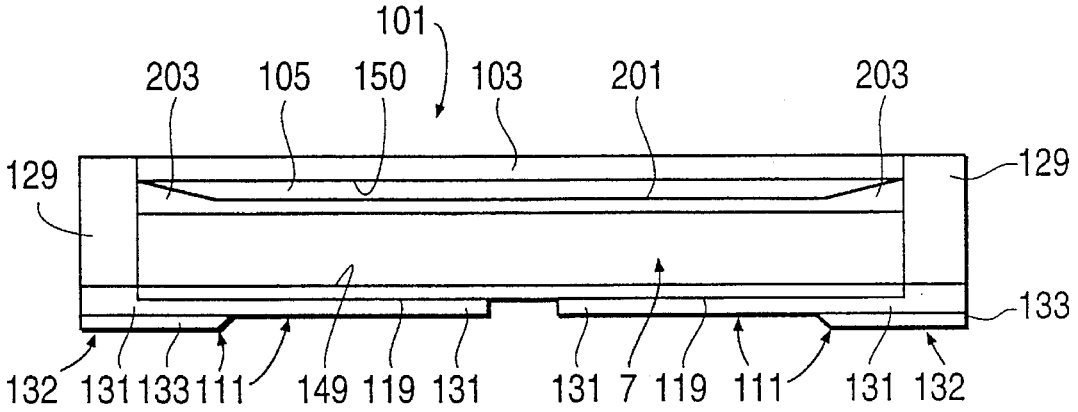
FIG. 11 represents a longitudinal cross-sectional view of the sharpener of FIG. 9.
Figure 12:
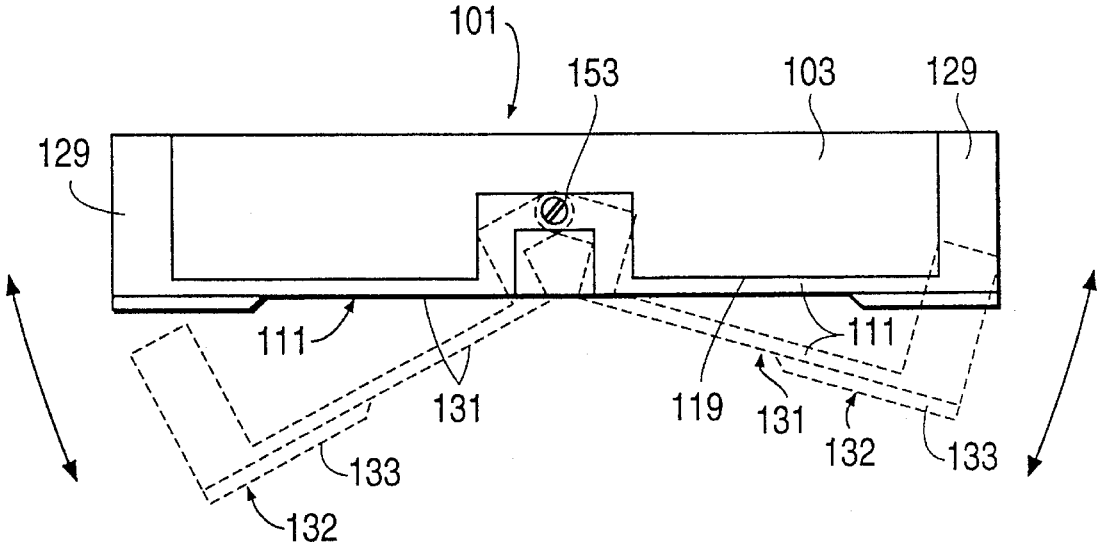
FIG. 12 represents a side elevational view of the sharpener of FIG. 9 (with the second members shown in two distinct positions, one position in full lines and another position in dotted lines)

Alternatively, with reference to FIG. 8*f*, the first member 507 may be replaced by a first member 507' similar to the first member 507 except grooves 510 and members 506 are replaced by a sheet of abrasive material 508. Of course, use of this first member 507' is similar to the one of the first member 507. Advantageously, openings 504 may be provided in the sheet 508 in order to not cover protuberances 521. The sheet 508 may be fastened on the outer longitudinal surface of the elongates supporting member 575 by any appropriated means such as gluing. Advantageously, the sheet of abrasive material 508 may be a sandpaper of the type already available on the market.

According to an optional aspect, the invention relates to a portable sharpener 101 similar to the one defined hereinbefore except the guiding means 11 are replaced by the guiding means 111 which comprise:

a longitudinal slot 117 provided in the body 103, having a pair of parallel banks 119 defining a determined width of said slot 117, said longitudinal slot 117 giving access to the housing 105 and extending parallel to the longitudinal axis of the body 103 and substantially along the whole length of said body 103;

a pair of second member 123, each second member 123 being provided with a pair of arms 125 having opposite ends, said arms 125 being spaced apart at such a distance from each other that they never cover the longitudinal slot 117 of the body 103, and at least a portion thereof defines a pair of banks 131 substantially aligned with banks 119 of the longitudinal slot 117, one end of each of said arms 125 being mounted on the body 103 while the opposite end of each of said arms 125 is solidly fastened to a third member which is maintaining the space between said arms, said third member 129 being able to be position beyond one end of the body 103;

a sliding surface 133 which is part of said third member 129;

and means 115 for moving at least a portion of the guiding means 111 parallel to lateral faces LF and/or LF', said means 115 comprising, aforesaid second members 123 where, for each second member 123 each end of said arms 125 opposite the ones solidly fastened to the third member 129 is pivotally mounted on the body 103 around a pivoting axis of said body said pivoting axis being at right angle with respect to the longitudinal slot 117, and each of said second members 123 being movable around its pivoting axis between a first and a second positions, the first position being defined when each bank 131 of one second member 123 is substantially parallel with the longitudinal axis of the body 103 and is substantially longitudinally extending a corresponding bank 131 of the second member 123 and the sliding surface 133 of each third member 123 is not lower than the abrasive surface 109 of the first member 107, the second position being defined when banks 131 of at least one of said second member 123 are at an angle with respect to the longitudinal axis of the body 103, said bank 131 of one second member 123 forming an angle with respect to banks 131 of the other second member.

Advantageously, rails 132 may be provided, those rails have a face extending the bank 131 in order to increase the surface contacting lateral faces LF or LF' of the blade B and further improve the positioning of the portable sharpener with respect to the cutting edges of the blade B.

Advantageously, each arm 125 may be provided at one of its end with an opening 149, and wherein each of said openings 149 may be aligned with one corresponding bore 151 provided in the body 103, then a pivot rod 153 may be engaged through said opening 149 and bore 151 for joining in a pivoting way the arms 125 and the body 103, said openings 149, bores 151 and rod 153 being co-axial with the pivoting axis. Preferably, as it is illustrated in FIGS. 9 to 12, a same pivot rod 153 may join in a pivoting way the opening 149 of one arm 125 of two second members 123 and a corresponding bore 151 of the body 103. According to a particularly preferred embodiment of the invention, as illustrated in FIGS. 9 to 12, each pivot rod 153 is threaded and provided with a head 155 for defining a bolt 157, each bore 151 in the body 103 is threaded, when the rod 153 of the bolt 157 has engaged an opening 149 of two corresponding arms 125 and press, by engagement in the threaded hole, said arms 125 against the body 103, the friction between the arms 125 and the body 103 is sufficient to prevent a free movement of said second members 123 but is insufficient to prevent said second members 123 to pivot under a slight pressure, when necessary.

The first member 107 may consist of a rounded and solid first member looking like a cylinder whose the outer cylindrical surface is abrasive (such a first member may be for example made of iron or steel), it is understood that this first member could also be made with all abrasive material and of any appropriate form and size.

The first member 107 may be mounted inside the body 103 by any appropriate fastening means.

According to another preferred embodiment, with reference to FIGS. 9 to 12, the invention relates to fastening means which may comprise a tongue 201 of elastic material provided with protuberances 203 at each of its ends, said protuberances 203 being of a height slightly superior to the distance separating the first member 107 from a ceiling 150 of this housing 105 where is housed the first member 107 to thus press the first member 107 against a floor 149 of the housing 105 and against the longitudinal slot 117.

For fastening a first member in a housing, we introduce under pressure said first member 107 by the end opening 106 of the housing 105 at the same time we introduce the tongue 201. The distance between the ceiling 150 and the floor 149 of the housing 105 being lesser that the height resulting from the diameter of the first member 107 and the protuberance 203, the friction will maintain in place the first member 107 in the housing 105. For removing the first member 107 from the housing 105, just carry out the above mentioned steps in the reverse way. The tongue 201 may be made of any appropriate material, in particular of plastic material.

Figure 16:
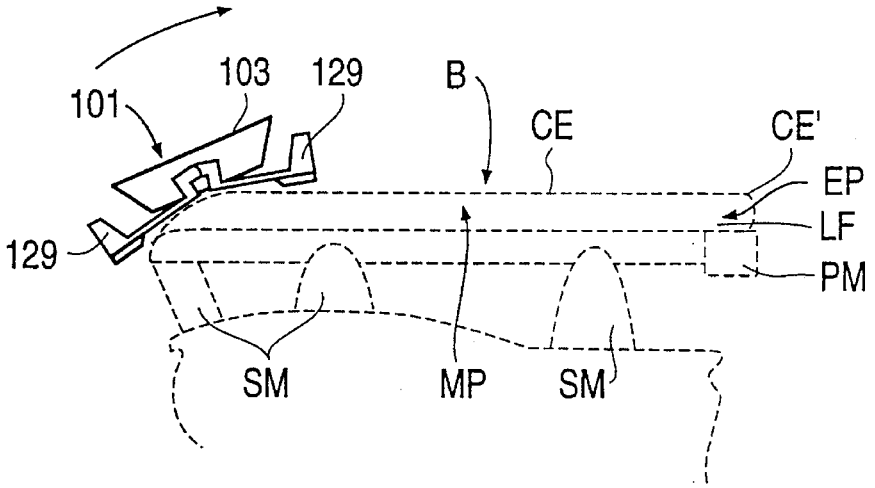
FIGS. 16 to 18 represent how the sharpener of FIGS. 9 to 12 is used.
Figure 17:
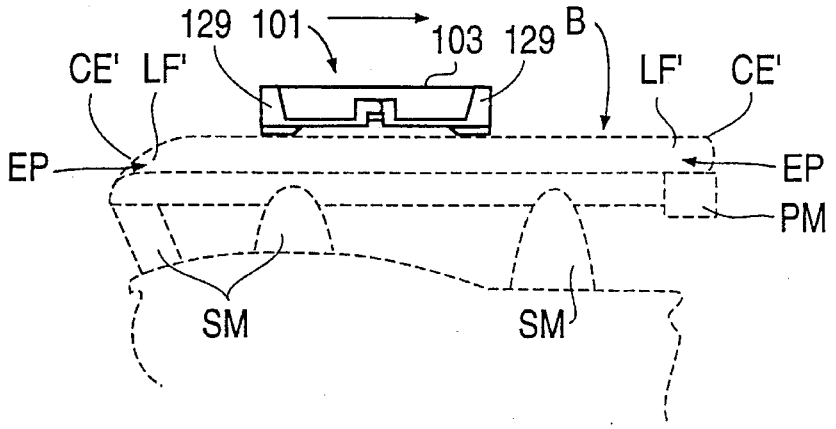
Figure 18:
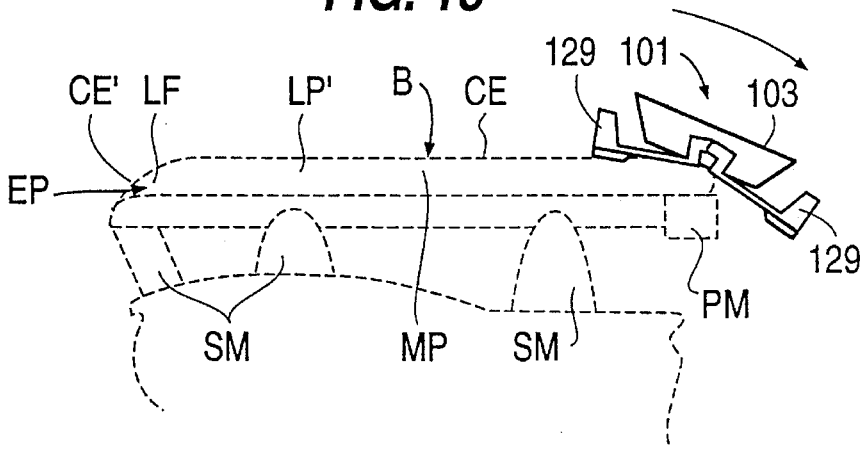

Referring to FIGS. 16 to 18, it is represented how we can use the sharpener represented in FIGS. 9 to 12. Thus, all what the user has to do is to move the members around the pivot in such a way that the banks 131 be facing the lateral face of the blade to be sharpened. The user only has to start to apply pressure by means of the first member against the cutting edges of the blade from end of the blade and to continue this pressure always in the same direction while taking care to adjust if necessary the position of the banks 131 so that these ones remain facing the lateral faces of the blade to sharpen.

Alternatively, for aforesaid sharpeners 1 and 101, fastening means may comprise a tongue provided with lateral edges intended to engage corresponding grooves provided in lateral walls of the housing where is housed the first member to thus press the first member against the floor of said housing where the longitudinal slot is located.

Alternatively, for aforesaid sharpeners 1 and 101 each ends of the first member may be provided with a cavity having at least one edge, and wherein fastening means consist of two support members having such a shape to match with the periphery of the housing where is housed the first member, each support member being provided with a central opening in which is positioned a shaft having opposite ends, one of the ends being provided with a connecting member comprising at least one edge and intended to engage a corresponding cavity at one end of the first member, and the opposite end of each shaft being provided with means allowing to connect it to a lever means the shaft being further provided, between the connecting member provided with at least one edge and a location where it enters in the corresponding support member with a stopper member, for thus allowing to mount the first member in a pivoting way inside the housing. Advantageously, means may be provided between the stopper member and a corresponding radial face of a corresponding support member for locking in a removable way the first member with respect to the support member.

Alternatively, for aforesaid sharpeners 1 and 101, there is also another possible way of fixation of a first member in the housing. This way may consist for example of at least one threaded hole and one threaded screw. Thus, screws may be screwed in corresponding threaded holes until one end of screws contact the first member and press this latter against a floor of the housing where is positioned the longitudinal slot. For example, for fastening a first member in the housing, we unscrew screw to allow to the first member to be freely introduced in the housing via an opening appearing at one end of the housing, then once the first member in place, we screw screws so that these one engage the first member and press it against a floor of the housing where is located the longitudinal slot. For withdrawing the first member from the housing, we only have to carry out the previous steps in the reverse way. Of course, when the first member is worn on one part of its surface, we may merely unscrew screws, turn the first member on its axis to bring an unworn portion of the surface vis-à-vis the longitudinal slot, then screw again screws.

Optionally, for aforesaid sharpeners 1 and 101, there is also another way for fixing the first member inside the housing. At this end, a tongue is provided with lateral edges intended to engage corresponding grooves provided in the lateral walls of a housing where is housed the first member, to thus press the first member against a floor of said housing and against the longitudinal slot. Of course, if the diameter of the first member is such that it is sensibly the same as the distance separating the floor and the ceiling of the housing, the use of the tongue may be omitted. For fixing a first member inside a housing, just introduce the first member by the end opening, then make the lateral edges slide in the corresponding grooves for maintaining the first member on the floor of the housing where the longitudinal slot is located. For withdrawing the first member from the housing, just carry out the previous steps in the reverse way.

Furthermore, the first member and tongue may be of a length superior to the one of the housing. In such a case, which is purely optional, the body may present a housing of appropriate configuration.

The present invention also covers all possible variations that could appear obvious for main skilled in the art. Furthermore, all the parts of the sharpener defined previously may be made of any known and appropriate materials, in particular of plastic materials (except for the first member or first member inserts defining abrasive surfaces which are either made of stone or metal such as steel).

The embodiment of the invention, in which an exclusive right of property or privilege is claimed, are defined are follows:

1. A portable sharpener for sharpening a blade of the type comprising a main portion provided with at least one cutting edge and at least one end portion provided with at least one cutting edge, said main portion having parallel lateral faces and said at least one cutting edge substantially straight or slightly curved and when more than one cutting edge is provided, the cutting edges being substantially parallel, each end portion extending one corresponding end of the main portion and having lateral faces parallel and coplanar with those of the main portion and having at least one cutting edge substantially curved, said sharpener comprising a body having a main longitudinal axis, a housing and including:

a first member having a longitudinal axis and at least one abrasive surface parallel to said longitudinal axis and to the longitudinal axis of the body, said first member being positioned inside the housing;

means for fastening the first member inside the housing;

guiding means formed on the body and adjacent the abrasive surface allowing a portion of the cutting edge of the blade to be moved against the abrasive surface of the first member and along the longitudinal axis of said first member;

means for recovering the filings obtained during the sharpening of the blade, said recovering means being located between said guiding means and the abrasive surface of the first member; and means connected to the body and engageable with the blade for moving at least a portion of the guiding means parallel to the lateral faces of the blade and to enable the first member housed in the body to substantially freely follow the contour of the edge of the blade at a proper angle relative thereto and maintain a portion of the faces between said guiding means during sharpening of the blade, including the substantially curved edge.

2. A portable sharpener for sharpening a blade of the type comprising a main portion provided with two parallel cutting edges and end portions each provided with substantially curved two parallel cutting edges, said main portion of the blade cutting edges that are slightly curved, said sharpener comprising a body having a main longitudinal axis, a housing and including:

first member having a longitudinal axis and at least one abrasive surface parallel to said longitudinal axis and to the longitudinal axis of the body, said first member being positioned inside the housing;

means for fastening the first member inside the housing;

guiding means formed on the body and adjacent the abrasive surface for allowing a portion of the cutting edges of the blade to be moved against the abrasive surface of the first member and along the longitudinal axis of said first member;

means for recovering the fragments obtained during the sharpening of the blade, said recovering means being located between said guiding means and the abrasive surface of the first member; and means connected to the body and engageable with the blade for moving at least a portion of the guiding means parallel to the lateral faces of the blade and to enable the first member housed in the body to substantially freely follow the contour of the edge of the blade at a proper angle relative thereto and maintain a portion of the faces between said guiding means during sharpening of the blade, including the substantially curved edges.

3. A portable sharpener according to claim 2, wherein the guiding means comprise:

a longitudinal slot provided in the body, having a pair of parallel banks defining a determined width of said slot, said longitudinal slot giving access to the housing and extending parallel to the longitudinal axis of the body and substantially along the whole length of said body;

a second member provided with a pair of arms having opposite ends, said arms being spaced apart at such a distance from each other that they never cover the longitudinal slot of the body, and that at least a portion thereof defines a pair of banks having at least a portion thereof substantially co-planar with banks of the longitudinal slot the body, one end of each of said arms being mounted on the body while the opposite end of said arms is solidly fastened to a third member which is maintaining the space between said arms, said third member being positionable beyond one end of the body; and a sliding surface which is part of said third member; and wherein the means for moving at least a portion of the guiding means parallel to lateral faces of the blade comprise said second member where each end of said arms opposite the one solidly fastened to the third member, is pivotally mounted on the body around a pivoting axis of said body, said pivoting axis being at right angles with respect to the longitudinal slot, said second member being movable around the pivoting axis between first and second positions, the first position being defined when each bank of the second member is substantially parallel with the longitudinal axis of the body and is substantially longitudinally extending a corresponding bank of the body and the sliding surface of the third member is not lower than the abrasive surface of the first member, the second position being defined when each of the banks of the second member is at an angle with respect to the longitudinal axis of the body.

4. A portable sharpener according to claim 3, wherein the sliding surface is the bottom of a groove provided in the third member.

5. A portable sharpener according to claim 4, wherein body is further provided with a pair of parallel rails having a determined height and length, being at a determined distance from each other and being respectively an integral part of at least a portion of one corresponding bank of the longitudinal slot and wherein the height of at least a portion of the pair of rails, near an end of the body opposite the one where the second member is positioned, is greater than the one of the remaining portion of said pairs of rails.

6. A portable sharpener according to claim 5, wherein means are further provided for removing barbs that may be created during the sharpening of the cutting edges.

7. A portable sharpener according to claim 6, wherein said means for removing barbs comprise in each lateral walls of the groove of the third member a housing, and a member having at least one abrasive surface and positioned in a corresponding housing in such a way to have its abrasive surface in contact with a corresponding lateral face of the blade and to remove barbs that may be created during the sharpening of the cutting edges.

8. A portable sharpener according to claim 7, wherein each arm is provided at one of its end with an opening, and wherein each opening is aligned with one corresponding bore provided in the body, then a pivot rod is engaged through said openings for joining in a pivoting way the arms and the body, said openings, bore and rod being co-axial with the pivoting axis.

9. A portable sharpener according to claim 2, wherein the guiding means comprise:

a longitudinal slot provided in the body, having a pair of parallel banks defining a determined width of said slot, said longitudinal slot giving access to the housing and extending parallel to the longitudinal axis of the body and substantially along the whole length of said body;

a second member provided with a pair of arms having opposite ends, said arms being spaced apart at such a distance from each other that they never cover the longitudinal slot of the body, one end of each of said arms being pivotably mounted on the body while the opposite end of said arms is solidly fastened to a third member which is maintaining the space between the arms, said third member being provided with a pair of opposed grooves which are respectively defining a pair of banks that are substantially coplanar with banks of the longitudinal slot of the body; and a sliding surface which is part of each groove of the third member; and wherein the means for moving at least a portion of the guiding means parallel to lateral faces of the blade comprise, said second members where each end of said arms opposite the ones solidly fastened to the third member is pivotally mounted on the body, said pivoting axis being at right angles with respect to the longitudinal slot, said second member being movable around the pivoting axis between a first or a second position and an intermediary position, a corresponding groove of the first or second position being defined when each bank of the third member is substantially parallel with the longitudinal axis of the body and is longitudinally extending a corresponding bank of the longitudinal slot and the sliding surface of said corresponding groove is not lower than the abrasive surface of the first member, the intermediary position being defined when each bank of the third member is at an angle with respect to the longitudinal axis of the body.

10. A portable sharpener according to claim 9, wherein the sliding surface is the bottom of a groove provided in the third member.

11. A portable sharpener according to claim 10, wherein the body is further provided with a pair of parallel rails having a determined height and length, said rails being at a determined distance from each other, each rail defining a bank extending a corresponding bank of the longitudinal slot, and wherein each rail has an intermediate portion of reduced height.

12. A portable sharpener according to claim 11, wherein means are further provided for removing barbs that may be created during the sharpening of the cutting edges.

13. A portable sharpener according to claim 12, wherein said means for removing barbs comprise in each lateral walls of the groove of the third member a housing, and a member having at least one abrasive surface and positioned in a corresponding housing in such a way to have its abrasive surface in contact with a corresponding lateral face of the blade and to remove barbs that may be created during the sharpening of the cutting edges.

14. A portable sharpener according to claim 13, wherein each arm is provided at one of its end with an opening, and wherein each opening is aligned with one corresponding bore provided in the body, then a pivot rod is engaged through said openings for joining in a pivoting way the arms and the body, said openings, bore and rod being co-axial with the pivoting axis.

15. A portable sharpener according to claim 2, wherein the guiding means comprise:

a longitudinal slot provided in the body, having a pair of parallel banks defining a determined width to said slot, said giving access to the housing and extending parallel to the longitudinal axis of the body and substantially along the whole length of said body;

a pair of second members, each second member being provided with a pair of arms having opposite ends, said arms being spaced apart at such a distance from each other that they never cover the longitudinal slot of the body, and at least a portion thereof defines a pair of banks substantially aligned with banks of the longitudinal slot of the body, one end of each of said arms being pivotally mounted on the body while the opposite end of said arms is solidly fastened to a third member which is maintaining the space between said arms, said third member being positionable beyond one end of the body; and a sliding surface which is part of said third member; and wherein the means for moving at least a portion of the guiding means parallel to lateral faces of the blade comprise said second members where, for each second member each end of said arms opposite the ones solidly fastened to the third member is pivotally mounted on the body around a pivoting axis of said body, said pivoting axis being at right angles with respect to the longitudinal slot, and each of said second members being movable around its pivoting axis between first and second positions, the first position being defined when each bank of one second member is substantially parallel with the longitudinal axis of the body and is substantially longitudinally extending a corresponding bank of the other second member and the sliding surface of the third member is not lower than the abrasive surface of the first member, the second position being defined when the banks of one of said second members are at an angle with respect to the banks of the other of said second members.

16. A portable sharpener according to claim 15, wherein each arm is provided at one of its end with an opening, and wherein each opening is aligned with one corresponding bore provided in the body, then a pivot rod is engaged through said openings for joining in a pivoting way the arms and the body, said openings, bore and rod being co-axial with the pivoting axis.

17. A portable sharpener according to claim 16, wherein a same pivot rod joins in a pivoting way the opening of one arm of each second members and a first bore provided in the body, and a second pivot rod joins in a pivoting way the opening of another arm of each of said second members and a second bore provided in the body, said openings, bores and pivot rods being co-axial with the pivoting axis.

18. A portable sharpener according to claim 17, wherein each pivot rod is threaded and provided with a head for defining a bolt, each bore in the body is threaded, and the rod of the bolt engages an opening of two corresponding arms and presses, by engagement in the threaded hole, said arms against the body so that friction between the arms and the body is just sufficient to prevent a free movement of said second members but is insufficient to prevent said second members to pivot under a light pressure, when necessary.

19. A portable sharpener according to claim 2, wherein the first member is mounted inside the housing by an appropriate fastening means.

20. A portable sharpener according to claim 19, wherein said fastening means comprise an elongated support having a longitudinal axis and opposite ends, said support being further provided with means for receiving the first member and means for pressing one abrasive surface of the first member against the floor of the housing and the longitudinal slot of the body, wherein said housing is of such a cross-section that the first member may move freely therein, and wherein said body is further provided with a first end opening giving access to the housing, said end opening being of such size not to interfere with the introduction of the first member in said housing.

21. A portable sharpener according to claim 20, wherein said means for receiving the first member comprise a longitudinal cavity where the first member is partly housed.

22. A portable sharpener according to claim 21, wherein said means for pressing one abrasive surface of the first member against the floor of the housing and the longitudinal slot of the body comprise a pair of inclined faces respectively provided near both ends of the housing and a pair of inclined faces respectively provided near each end of the support, said inclined faces being so positioned that when the support is introduced in the housing according to an axis substantially parallel with the longitudinal axis of the body, they come into mutual contact and move the support toward the floor of the housing and thereby press one abrasive surface of the first member against the longitudinal slot the body, the friction between inclined faces being sufficient to removably lock the first member inside the housing.

23. A portable sharpener according to claim 22, wherein the first member has several abrasive surfaces, and wherein said fastening means are further provided with means allowing to position the first member around its longitudinal axis and selectively position one of said abrasive surfaces vis-à-vis the longitudinal slot.

24. A portable sharpener according to claim 23, wherein said means allowing to position the first member comprise a polygonal member making an integral part of at least one end of the first member and the cavity provided in the first member receiving means.

25. A portable sharpener according to claim 24, wherein the abrasive surfaces of the first member are separated from each other by a longitudinal groove.

26. A portable sharpener according to claim 19, wherein said fastening means comprise a tongue of elastic material provided with protuberances at each of its ends, said protuberances being of a height slightly superior to the distance separating the first member from a ceiling of the housing that houses the first member for thus pressing the first member against a floor of the housing and against the longitudinal slot.

27. A portable sharpener according to claim 26, wherein said first member comprises an elongated supporting member, at least two abrasive members each provided with at least one abrasive surface, means for removably fastening said abrasive members on said elongated supporting member, and means for removably positioning one abrasive surface vis-à-vis the longitudinal slot.

28. A portable sharpener according to claim 27, wherein said means for removably fastening each abrasive member on said elongated supporting member comprises:

a groove provided in the elongated supporting member, parallel to the longitudinal axis of the first member, having a determined depth and a pair of walls substantially parallel to each other and perpendicular to the longitudinal axis of the elongated member, an abrasive member having a longitudinal axis parallel to the longitudinal axis of the first member, a pair of opposite walls parallel to its longitudinal axis and a pair of opposite abrasive surfaces substantially perpendicular to the opposite walls, said lateral walls being spaced apart at such a distance from each other to contact corresponding walls of the elongated supporting member and said abrasive surfaces being spaced apart from each other at such a distance from each other that when one of said surface is against the bottom of a corresponding groove of the elongated supporting member, the opposite abrasive surface is projecting out of said groove.

29. A portable sharpener according to claim 28, wherein said means for removably positioning one abrasive surface vis-à-vis the longitudinal slot and the floor of the housing comprise:

at least one protuberance provided on said elongated supporting member, at least two grooves provided in the housing, each groove being parallel to the longitudinal axis of the body and shaped to receive the protuberance, said grooves being spaced apart from each other in the housing so that when one protuberance engages one of said groove, one abrasive surface is aligned with the longitudinal slot and when the protuberance engages another groove, another abrasive surface is aligned vis-à-vis the longitudinal slot.

30. A portable sharpener according to claim 24, wherein said first member comprises an elongated supporting member having at least one outer longitudinal face, at least a sheet of abrasive material having an abrasive surface and means for fastening the sheet of abrasive material on the outer longitudinal face of the elongated supporting member.

31. A portable sharpener according to claim 30, wherein the housing has four grooves, wherein each groove is provided with two wedge-shaped protuberances, wherein the elongated supporting member is provided with four rows of two wedge-shaped protuberances, and wherein for each row of protuberances on the elongated supporting member, two corresponding protuberances are provided in a corresponding groove, each protuberance of the groove having an inclined face that can match with an inclined face of a corresponding protuberance of a row of protuberances so that when said inclined surfaces are slid one against the other the friction existing between said surfaces is sufficient to removably lock the elongated supporting member in the housing.

32. A portable sharpener according to claim 29, wherein the elongated supporting member has four grooves and four abrasive members.

33. A portable sharpener according to claim 32, wherein the housing has four grooves, wherein each groove is provided with two wedge-shaped protuberances, wherein the elongated supporting member is provided with four rows of two wedge-shaped protuberances, and wherein for each row of protuberances on the elongated supporting member, two corresponding protuberances are provided in a corresponding groove, each protuberance of the groove having an inclined face that can match with an inclined face of a corresponding protuberance of a row of protuberances so that when said inclined surfaces are slid one against the other the friction existing between said surfaces is sufficient to removably lock the elongated supporting member in the housing.

* * * * *